United States Patent [19]

Björlund

[11] 4,364,634

[45] Dec. 21, 1982

[54] REFLECTION DEVICE FOR ROADSIDE MARKING

[76] Inventor: John Björlund, Södra Vägen 93, Göteborg, Sweden, 412 54

[21] Appl. No.: 187,844

[22] PCT Filed: Mar. 20, 1979

[86] PCT No.: PCT/SE79/00061

§ 371 Date: Nov. 22, 1979

§ 102(e) Date: Nov. 20, 1979

[87] PCT Pub. No.: WO79/00809

PCT Pub. Date: Oct. 18, 1979

[30] Foreign Application Priority Data

Mar. 22, 1978 [SE] Sweden ..... 7803272
May 30, 1978 [SE] Sweden ..... 7806183

[51] Int. Cl.[3] ..... G02B 5/12

[52] U.S. Cl. ..... 350/97; 404/9; 350/319; 350/590

[58] Field of Search ..... 350/58, 59, 61, 64, 350/65, 67, 97–109, 319; 404/6, 9; 116/63 R, 63 P

[56] References Cited

U.S. PATENT DOCUMENTS 1,659,409 2/1928 Porter ..... 340/366 R
3,989,351 11/1976 Bjorlund ..... 350/97

FOREIGN PATENT DOCUMENTS 2426427 12/1975 Fed. Rep. of Germany .

*Primary Examiner*—R. A. Rosenberger
*Attorney, Agent, or Firm*—Holman & Stern

[57] ABSTRACT

A reflective roadside marking post, where the reflector is protected from dirt by a tubular means projecting in front of the reflector. The tubular means is by partition walls divided into a number of axial channels or cells and the reflector is visible through said cells. In order to make the reflector reachable for cleaning purposes it and/or the tubular means is/are moveable in relation to the post.

9 Claims, 19 Drawing Figures

REFLECTION DEVICE FOR ROADSIDE MARKING

BACKGROUND OF THE INVENTION

The present invention refers to a reflection device for roadside marking and of the type comprising at least one tubular means projecting in front of the reflector, said tubular means being intended to provide a stationary air cushion in front of the reflector.

Reflection posts are used for improving the visual guiding in darkness on roads where a stationary road lighting is missing and contribute to essentially improve the traffic safety. Many drivers have when driving in the dark felt the unpleasant feeling of not surely knowing how the road is leading especially when they are dazzled or when the windscreen is spattered. Critical situations caused by this could be avoided if the road boarders were marked with reflection posts. The reflection posts previously used have been affected by dirt very soon, whereby the reflection ability is decreased, and the necessary cleaning is time-requiring and expensive.

As examples of reflection posts where the reflective material is unprotected and therefore quickly is soiled can be mentioned the reflection posts shown in the Swedish patent specification Nos. 317,015 and 366,081.

In the Swedish patent specification No. 378,631 is shown a reflection post, where the reflector is placed in and protected by a tube and where the tube portion pprojecting in front of the reflector is of a sufficient length for the provision of a protecting air cushion in front of the reflector. The reflector is furthermore removable from the tube in order to facilitate the cleaning. Comparative tests initiated by the National Swedish Council for Road Safety Research with other reflection posts have clearly proved the superiority of this reflection post regarding need of cleaning and visibility. The visibility was about 3 times higher than for the next best reflection post while the need of cleaning was only ⅓ than for the other posts.

By e.g. the Swedish patent specificiation No. 55,240 and the U.S. patent specification No. 1,659,409 it is previously known to arrange in front of car headlights a device comprising a great number of cells with a relatively high ratio length/diameter. The light beams from the headlights are thereby prevented from diverging to any essential extent and the dazzling effect from the headlight is prevented. p Thus these publications describe devices for delivering light while the present invention refers to a device for reflecting light. These two previously known devices would not be applicable for the purpose of the present invention, viz. to prevent the reflector from being affected by dirt and retaining a good reflection ability. The device described in the Swedish patent specification No. 55,240 has a far too high ratio between length and diameter of the cells, for achieving any practically usuable reflection ability. The device described in the U.S. patent specification No. 1,659,409 can on the other hand not act as a soil protection, since there is an opening between the headlights and the device and no air cushion which would prevent soiling can therefore be formed.

SUMMARY OF THE INVENTION

The purpose of the invention is to provide a reflection post of the type described in the introduction, which has the advantages of providing a prevented or delayed soiling and simple cleaning of the reflector at the same time as the length of the tubular means is considerably reduced. This has according to the invention been achieved by the fact that the tubular means is divided into a plurality of substantially axial channels by means of partition walls, where in each channel the axial length of the channel is at least equal to half the inner transverse dimension of the channel for providing the desired air cushion effect and where the ratio between the axial length of the channel and the inner transverse dimension of the channel is within a limit for providing a visually roadside marking reflection effect of the incident light from the headlamps of the vehicles passing on the adjacent road and that the post is provided with guide means for the tubular means, which is insertable or fittable into the post, so that it at least substantially is received within the limiting surfaces of the post or its imaginary extensions.

By dividing the tubular means into several axial channels the length of the tubular means can be considerably reduced retaining the air cushion effect, which prevents or delays soiling of the reflector.

DESCRIPTION OF THE DRAWINGS

The invention will now be further described with reference to some embodiments shown in the accompanying drawings.

DESCRIPTION OF SOME EMBODMENTS

Figure 1:
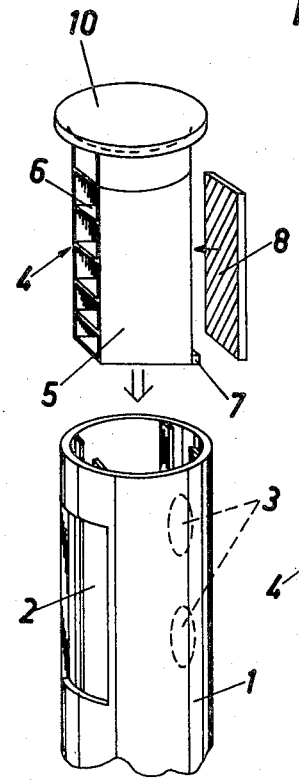
FIG. 1 is a perspective exploded view of the upper part of a post with reflection device.

The roadside marking post according to the embodiment shown in FIG. 1 is denoted with the numeral 1 and comprises a tube, which at its upper portion is provided with a rectangular opening 2 and on the opposite side with two circular openings 3. Through the upper open end of the post 1 a dirt protection means 4 is insertable. Sid dirt protection means 4 comprises an outer frame 5, which by means of a number of partition walls 6 forms a tubular means comprising a number of cells, whereby the length of each cell is at least equal to half the inner cross-section of the cell. The end of the frame 5 located in front of the openings 3 has a projecting lip 7, against which a reflection plate 8 is intended to abut. The reflector 8 is visible through the rectangular opening 2 through the cells of the tubular means 4 as well as through the circular openings 3. At one of the short ends of the tubular means 4 is provided a plate 10, which when the tubular means is inserted in the post forms a termination or cover of the post 1.

When the reflector 8 is to be cleaned the tubular means 4 is pulled out of the post, so that the reflector can be removed.

Figure 2:
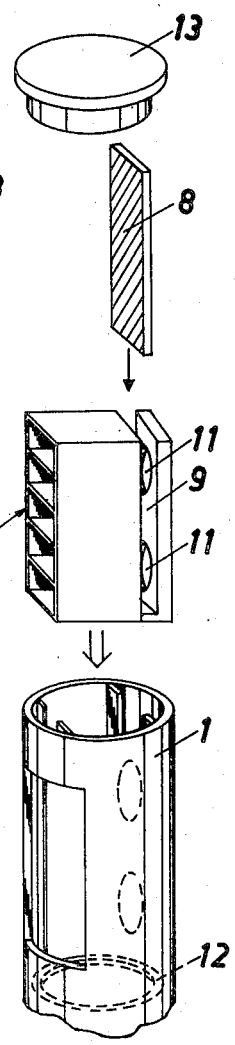
FIG. 2 is an analogue view of a modified reflection device according to the invention.

The embodiment shown in FIG. 2 differs from the embodiment of FIG. 1 by the fact that the tubular means 4 is provided with a rear end wall 9, which at its lower end is connected to the tubular means 4. An aperture for the reflector is formed between the end wall 9 and the tubular means 4. In the end wall 9 are provided two circular holes 11 intended to be arranged just opposite the openings 3 in the post 1. The tubular means 4 is pushed down in the post 1 until it abuts a stop 12 in the post. The length of the reflector 8 exceeds the depth of the aperture 11, so that a grip end is provided. When cleaning the reflector 8 the tublar means 4 can be left in the post 1. The tubular means 4 can possibly be fixed to the post 1 in any suitable way, e.g. by screws. A removable cover 13 is provided as an end termination of the post.

Figure 3:
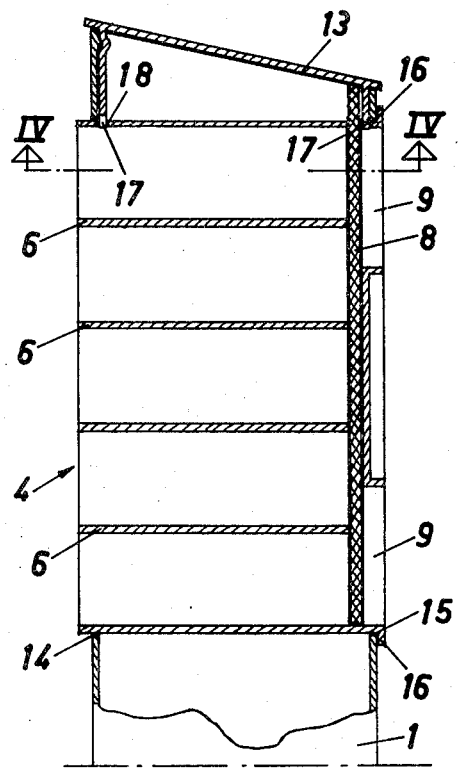
FIG. 3 is a section through a further embodiment of the invention.
Figure 4:
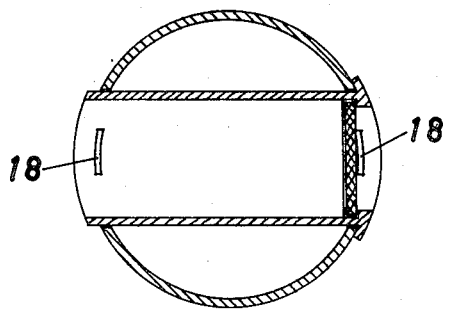
FIG. 4 is a section along line IV—IV in FIG. 3, FIGS. 5, 6 and 7 are horizontal sections through further embodiments of the reflection device.

In the embodiment according to FIGS. 3 and 4 the tubular means 4 can be inserted through side openings 14 and 15 in the post 1. The tubular means has principally the same design as the one shown in FIG. 2, but it is furthermore provided with a stop edge 16 limiting the insertion of the tubular means 4 in the post 1. The tubular means is secured against displacement on one hand thereby that the reflector 8 projects somewhat above the tubular means and on the other hand thereby that the cover 13 for the post is provided with locking pins 17 cooperating with corresponding recesses 18 in the tubular means 4.

According to this embodiment it is only required that the cover 13 is removed for making it possible to reach the reflector 8 for cleaning. If also the tubular means 4 has to be cleaned it can easily be removed from the post after removal of the reflector.

Figure 5:
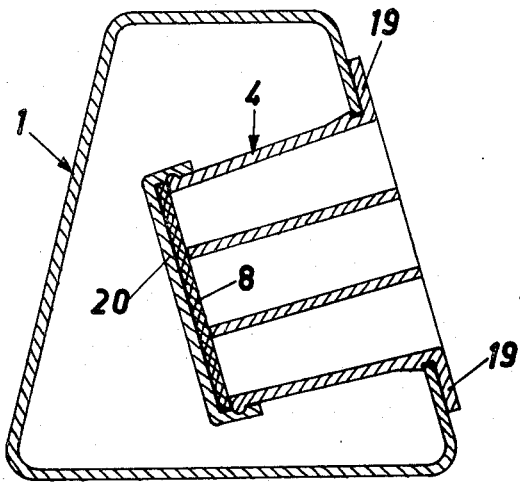
Figure 6:
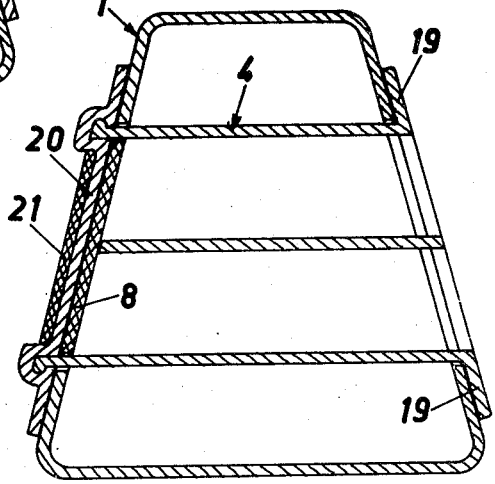

In the embodiment according to FIGS. 5 and 6 the tubular means is inserted through a side opening in the post 1. The tubular means 4 has a border 19 gripping round said side opening in the post and thus limiting the insertion of the tubular means in the post. The tubular means 4 is secured to the post 1 e.g. by screws or snap-in members.

The reflector 8 is kept in place by a cover 20, which is snapped on the tubular means 4. In the embodiment according to FIG. 5 the tubular means 4 does not extend right through the tube 1, but only a part into it, whereas in the embodiment according to FIG. 6 the tubular means 4 extends through the post and out through a side opening in the opposite side of the post. A second reflector 21 is placed in a recess on the outside of the cover 20.

In order to reach the reflector 8 for cleaning purposes it is in the embodiment according to FIG. 5 necessary to remove the tubular means 4 through the side opening and the cover 20 from the tubular means. In the embodiment according to FIG. 6 is it sufficient to remove the cover 20 from the tubular means 4, whereby the reflector 8 can be reached.

Figure 7:
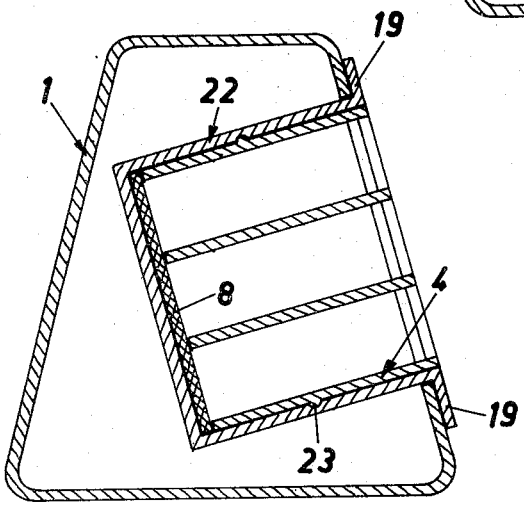

In the embodiment according to FIG. 7 an insert 22 is placed in the side opening in the post 1, said insert 22 having a border 23 gripping round the side opening. The insert 22 is fixed to the post 1. The tubular means 4 can be detachably secured to the insert 22, e.g. by means of beads 23 which are pressed into openings or cavities in the insert. The reflector 8 is secured between the insert 22 and the tubular means 4 and can be reached for cleaning by removing the tubular means from the insert.

In the embodiment according to FIGS. 8–15 the reflector 8 is fixed to the post 1 close to the upper end thereof. Such reflection posts are common in many countries, but have as previously suffered from the drawback of being dirty very quickly, whereby the reflection ability is considerably decreased. In order to avoid this a dirt protection comprising a tubular means 4 of the above mentioned type is placed in front of the reflector 8.

Figure 8:
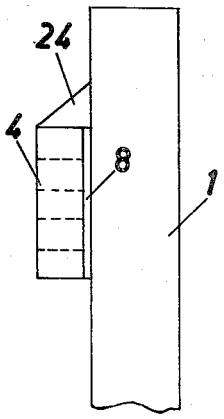
FIGS. 8–14 are side, front or perspective view of different types of reflection devices according to the invention.
Figure 9:
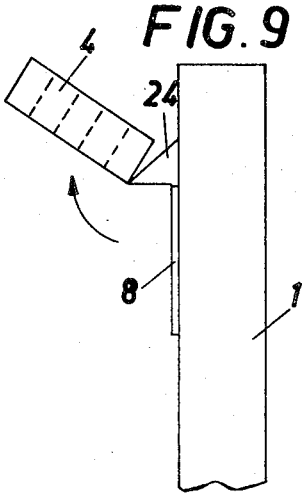

In order to facilitate cleaning of the reflector 8 the tubular means 4 must be removed, which can be made in many different ways. In FIGS. 8 and 9 the tubular means 4 is pivotally mounted to a bracket 24, which is placed above the reflector 8. The tubular means 4 can easily be pivoted upwards as shown in FIG. 9, thus leaving the reflector 8 free for cleaning. The tubular means 4 is preferably detachably secured at its lower edge to the reflector 8 or the post 1 e.g. by snap action.

Figure 10:
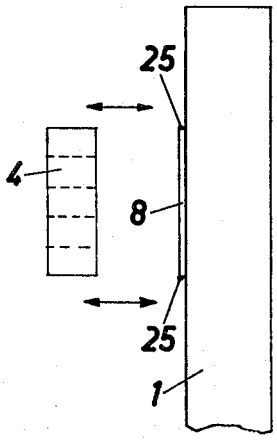

In the embodiment according to FIG. 10 the tubular means can be snap-locked round beads 25 at the upper and lower edges of the reflector 8.

Figure 11:
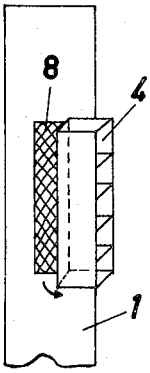
Figure 12:
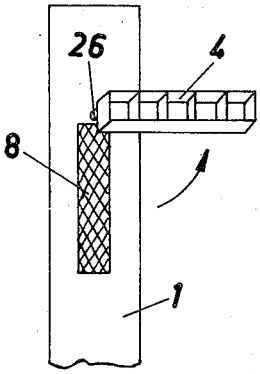

In the embodiment according to FIG. 11 the tubular means 4 is pivoted about hinges at one of its long sides and in FIG. 12 the tubular means is pivoted about a hinge 26 at its upper edge.

Figure 13:
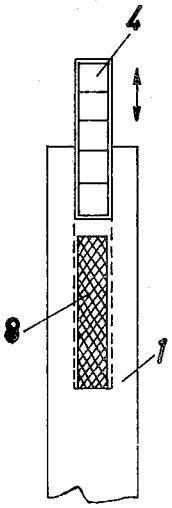
Figure 14:
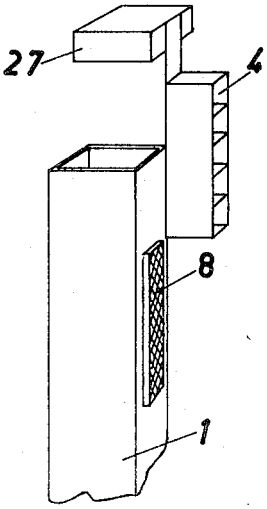
Figure 15:
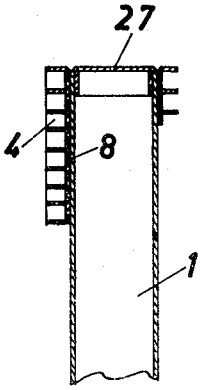
FIG. 15 is a vertical section through another embodiment of the reflection device.

In the embodiment of FIG. 13 the tubular means 4 can be pushed down in front of the reflector 8 in guides and be removed by pulling it upwards. The same applies for the embodiment according to FIG. 14, but here the tubular means 4 is connected with a cover 27 forming an end termination of the post 1. In the embodiment according to FIG. 15 the cover 27 is pivotally connected to the tubular means 4. The embodiment according to FIGS. 16 and 17 differs from the above described embodiments by the fact that the reflector or reflectors 8 are secured to a member 28 projecting from the post 1, which in this case has a triangular cross-section, said member 28 having shoulders 29 on opposite sides behind which shoulders a pair of partition walls 6 of the tubular means 4 grip. The tubular means 4 comprises two halves, arranged on opposite sides of the member 28 in front of the reflectors 8 and which can be turned about hinges and make the reflectors 8 free for cleaning. The halves are by snap action locked to beads 30 on the member 28. The reflection device can be manufactured as a separate unit, which can be attached to an ordinary post.

Figure 16:
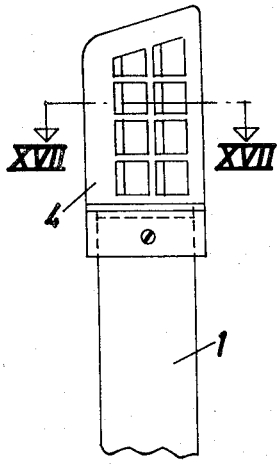
FIG. 16 is a front view of a further embodiment of the reflection device.
Figure 17:
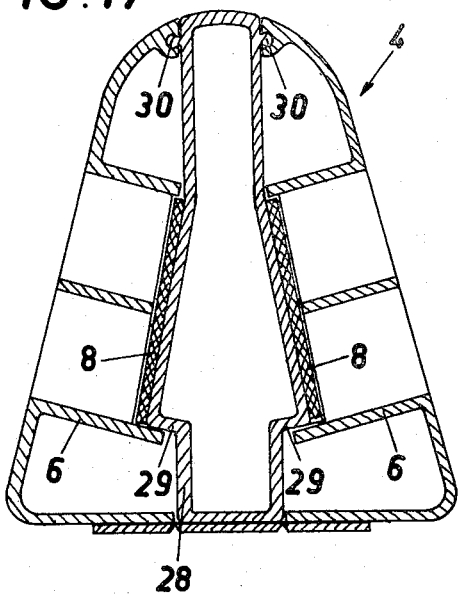
FIG. 17 is a section on a larger scale along line X—X in FIG. 16.
Figure 18:
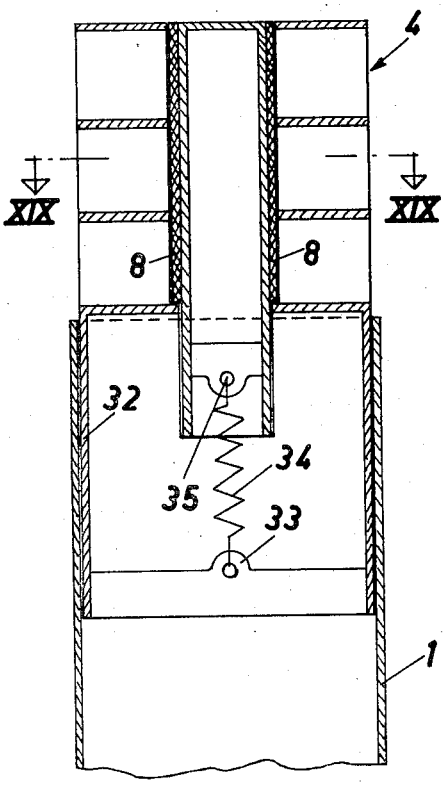
FIG. 18 is a vertical section through a further embodiment of the reflection device.
Figure 19:
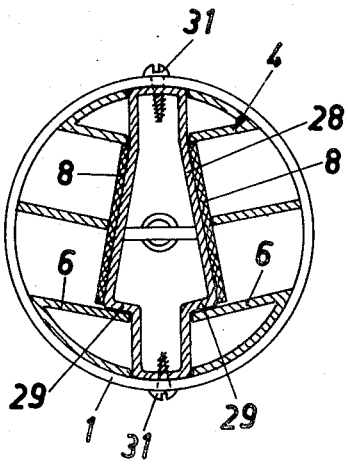
FIG. 19 is a section along line XII—XII in FIG. 18.

In the embodiment according to FIGS. 18 and 19 the reflector or reflectors 18 are in the same way as in FIGS. 16 and 17 fixed to the member 28 projecting from the post 1, which in this case has a circular cross-section, said member 28 being screwed 31 to the post 1. The tubular means 4 is integrally connected with a portion 32 projecting down into the post 1, said portion 32 having an attachment 33 for a spring 34. The spring 34 is at its opposite end connected to an attachment 35 in said member 28. The tubular means 4 and the connected portion 32 can be pushed downwards in the post 1 against the action of the spring 34, whereby the reflectors 8 are free for cleaning.

An automatic cleaning would in this case be possible, where a device with rotating brushes is placed on the tubular means 4 pressing this downwards and simultaneously cleaning the reflectors 8. The tubular means 4 automatically returns to its initial position when the pressure from the device with the rotating brushes is interrupted. The invention is not limited to the embodiments described above but can be varied within the scope of the claims.

I claim:

1. In a reflective road marker of the type including a reflector supported at a specified height above the road, said reflector being removably carried by tubular means on a post beside the road, the improvement comprising:

said reflector being supported by said post for reflection of light, directed thereat, generally toward a first direction, being held behind said tubular means within said post and being removable from said post;

said tubular means being insertable into said post through an opening therein to a position where it at least substantially is received within said post, and including a plurality of channels, each channel (1) having its length in said first direction;

(2) being closed at one end by said reflector and coacting therewith to define a stationary air cushion in front of said reflector;

(3) having its length at least one-half the maximum internal transverse dimension; and (4) having a length-to-transverse-dimension ratio such that a visually roadside marking reflection effect of the incident light from the headlights of vehicles is provided at different positions on the road.

2. A reflection device according to claim 1, wherein means for detachably holding the reflector are arranged at one end or side of the tubular means.

3. A reflection device according to claim 8, wherein said tubular means is insertable through a side opening in the post to a position where it at least substantially is received within the post and that the reflector is held behind the tubular means within the post and is removeable from the post.

4. A reflection device according to claim 1, wherein the reflector or reflectors is/are attached to a member projecting upwards from and being fixed to the post, the tubular means in one position being arranged in front of the reflector or reflectors and in this position together with said member projecting from the post forming an extension of the post with substantially the same cross-sectional shape as this and in another position is arranged to expose the reflector or reflectors for cleaning purposes.

5. In a reflection device for roadside marking of the kind comprising a reflector supported at a certain height above the road by a post placed beside the roadside and tubular means projecting in front of the reflector, said tubular means being intended to provide a stationary air cushion in front of the reflector and being removable from the reflector for making the latter accessible for cleaning, the improvement comprising:

said post being provided with guide means for facilitating insertion of said tubular means into said post, whereby when said tubular means is inserted into said post, it lies substantially within the limiting surfaces of said post or its imaginary extensions.

6. The improvement of claim 5 wherein said tubular means is insertable into said post through an open upper end thereof to a position where it at least substantially is received within said post, and said reflector is held behind the tubular means within the post and is removable therefrom.

7. The improvement of claim 6 wherein said tubular means includes means for detacably holding the reflector, said holding means being located at one end or side of said tubular means.

8. The improvement of claim 5 wherein said tubular means is insertable through a side opening in said post to a position where it at least substantially is received within said post, and said reflector is held behind said tubular means within said post and is removable therefrom.

9. The improvement of claim 5 wherein at least one reflector is attached to a member projecting upwardly from, and fixed to, the post, said tubular means in one position being arranged in front of said at least one reflector, and in this position together with said member, projects from said post to form an extension thereof with substantially the same cross-sectional shape as said post, and in another position being arranged to expose the reflector for cleaning purposes.

* * * * *